US010689857B2

(12) United States Patent
Van Lennep

(10) Patent No.: US 10,689,857 B2
(45) Date of Patent: Jun. 23, 2020

(54) RAILING SYSTEM WITH CONCEALED ANCHOR SYSTEM

(71) Applicant: Hector Van Lennep, Fernandina Beach, FL (US)

(72) Inventor: Hector Van Lennep, Fernandina Beach, FL (US)

( * ) Notice: Subject to any disclaimer, the term of this patent is extended or adjusted under 35 U.S.C. 154(b) by 568 days.

(21) Appl. No.: 15/461,437

(22) Filed: Mar. 16, 2017

(65) Prior Publication Data

US 2018/0266141 A1 Sep. 20, 2018

(51) Int. Cl.
*E04F 11/18* (2006.01)

(52) U.S. Cl.
CPC ..... *E04F 11/1812* (2013.01)

(58) Field of Classification Search
CPC ..... E04F 11/1812; E04F 11/1834; E04F 2011/1819; E04F 2011/1821; E04F 2011/1823; E04F 2011/1827; E04F 2011/1859; E04F 2011/1868; E04H 17/10; E04H 17/12; E04H 17/1421; E04H 17/22; E04H 2017/1491
USPC ..... 256/65.07, 65.14, 67
See application file for complete search history.

(56) References Cited

U.S. PATENT DOCUMENTS 1,159,856 A * 11/1915 Michod ..... E04H 17/22 52/150
1,290,416 A * 1/1919 Tuell ..... E04H 17/12 256/58
1,517,119 A * 11/1924 Luhring ..... E04H 17/10 256/57
1,857,435 A * 5/1932 Cole ..... E01F 15/06 256/13.1
2,315,516 A * 4/1943 Gray ..... E04H 17/22 256/1
3,881,698 A * 5/1975 Marsh ..... E04G 21/3233 256/59
6,141,928 A * 11/2000 Platt ..... E04F 11/1812 256/65.14
6,290,212 B1 * 9/2001 Bartel ..... E04F 11/1812 256/65.14
7,802,351 B2 * 9/2010 McGinness ..... E04H 12/2253 256/65.14
7,913,983 B1 * 3/2011 Sandor, Sr. ..... E04F 11/1812 256/67
8,356,803 B2 * 1/2013 Truckner ..... E04F 11/1834 256/67
9,145,705 B2 * 9/2015 Herman ..... E04H 17/22
9,169,651 B1 * 10/2015 Wynne ..... E04F 11/1834
9,976,298 B2 * 5/2018 Bergman ..... E04F 11/1812
(Continued)

FOREIGN PATENT DOCUMENTS

CA 2842901 A1 * 8/2015 ..... E04H 17/20
DE 29509791 U1 * 10/1995 ..... E04F 11/1834
DE 20021827 U1 * 3/2001 ..... E04F 11/1812
(Continued)

*Primary Examiner* — Josh Skroupa
(74) *Attorney, Agent, or Firm* — Wilso Dutra, PLLC; Camille A. Wilson

(57) ABSTRACT

A railing system may comprise a series of railing modules, wherein a railing module may comprise a single railing post. The series of railing modules may comprise a mix of standard railing posts and corner railing posts, wherein the series may form a railing border around a surface, such as a deck, porch, or patio.

20 Claims, 10 Drawing Sheets

(56) References Cited

U.S. PATENT DOCUMENTS

| | | | | |
|---|---|---|---|---|
| 2016/0281752 | A1* | 9/2016 | Koller | E04F 11/1812 |
| 2016/0312491 | A1* | 10/2016 | Breen | E04H 17/22 |

FOREIGN PATENT DOCUMENTS

| | | | | |
|---|---|---|---|---|
| DE | 10358766 | A1 * | 7/2005 | E04F 11/1812 |
| FR | 2476191 | A1 * | 8/1981 | E04H 17/12 |
| WO | WO-2005108718 | A1 * | 11/2005 | E04H 17/12 |

* cited by examiner

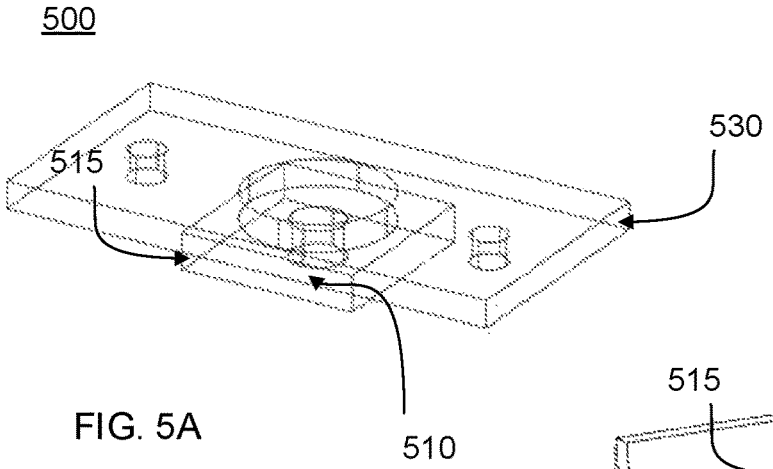
FIG. 5A
FIG. 5B
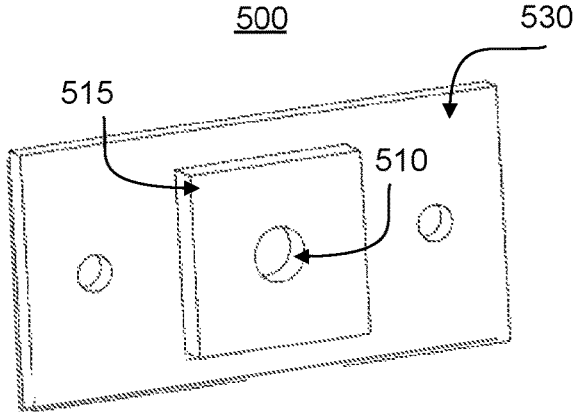
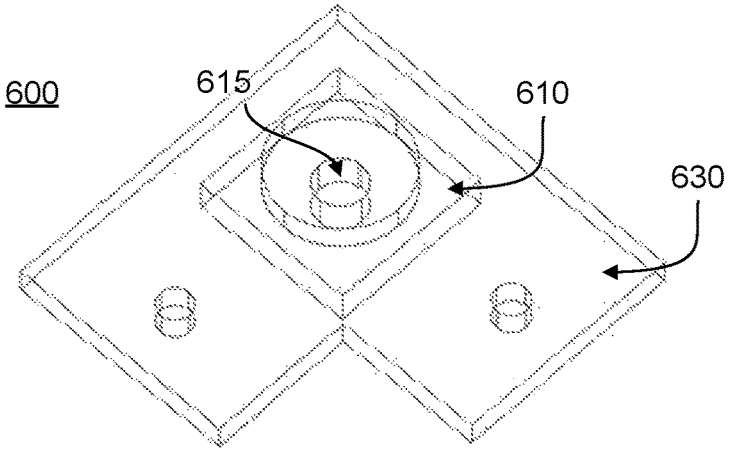
FIG. 6A
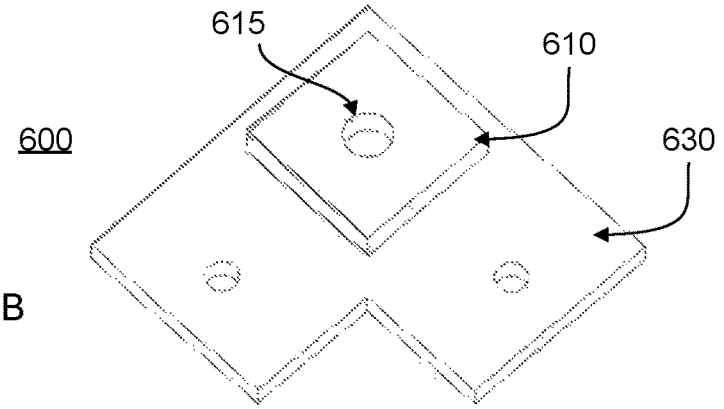
FIG. 6B

RAILING SYSTEM WITH CONCEALED ANCHOR SYSTEM

BACKGROUND OF THE DISCLOSURE

Architecture with designs that require a railing have been common for centuries. For example, a deck is a flat surface capable of supporting weight connected to a building. It is customarily constructed outdoors and is often elevated from the ground. Verandas and observation decks are variations on how a deck may be implemented in residential and commercial buildings. Decks usually have post and beam architecture or cantilever construction. Post and beam construction uses posts anchored to piers in the ground. Cantilever decks use floor joists to stabilize the floor. Upon installation, decks must be waterproofed and flashed to minimize significant safety issues.

These structural decks are then enclosed by railings to further ensure safety, and the railings provide an opportunity to add an aesthetic detail to the construction. These railings are available in a variety of forms, though the appropriate railing may depend on what type and design of building is constructed. For example, there are hand railings, deck railings, cable railings, and guard rails. Each of these railings have specific guidelines or requirements for structural strength and height. Railings may also have different height requirements depending on who the principal user of the railing might be, such as an adult, a child, or a person with a disability.

Each railing may also have different requirements depending on which railing type is being used. A cable railing, for example, may provide support while not obstructing someone's view. This results in thinner cable being used for installation. To compensate for the difference in railing, a cable railing requires more rigid frames to counteract the force applied to the end posts by tensioning the cables. Cables must be adhere to building code requirements and provide minimal cable deflection.

Each railing system is made of disparate components tailored to that particular railing system. However, currently, the primary method of installing railing systems is to make the structural connection to the deck after waterproofing and after deck finishes have been installed. Further, a railing is often attached to the posts through a similarly invasive method. This creates a potential failure point for water intrusion, which leads to safety issues and risk of serious injury.

SUMMARY OF THE DISCLOSURE

What is needed is a system to secure a structural post prior to waterproofing and prior to deck finishes being installed. Further needed is a railing system that allows for the railing to connect without piercing the railing posts, finished deck, or any underlying waterproofing system. As a result, this limits the problems associated with structural fastening and waterproofing failures. This system can be used to secure railings in its various iterations, secure steps and stairs, and fortify guardrails.

The present disclosure relates to a railing system comprising: a plurality of railing modules, where each railing module comprises a concealed anchor system, a railing post, a retainer cap, and a railing post. The railing system may comprise a stud extending vertically from a support surface. The railing system may comprise a sleeve centered around the stud extending perpendicular to the support surface. The railing system may comprise a railing post configured to fit around the sleeve, where the railing post comprises a bottom opening configured to accept the sleeve and a top opening. The railing system may comprise a retainer cap connector detachably connected and extending vertically from the stud. The railing system may comprise a retainer cap configured to fit into the top opening, where the retainer cap is detachably connected to the retainer cap connector. The railing system may comprise a railing detachably connected to the retainer cap, where the railing connects at least a portion of the plurality of railing modules.

In some aspects, a railing module may further comprise a securing mechanism detachably connected to one or both the stud and the retainer cap connector, where the securing mechanism strengthens the connection between the stud and the retainer cap connector. In some implementations, the railing module may further comprise a shoe configured to fit over the railing post, where the shoe is in contact with the support surface. The railing post may further comprises at least a first flange extending perpendicular to the railing post, where the first flange comprises one or more recesses or openings configured to fit at least one secondary railing detachably connected to at least the portion of the plurality of railing modules. In some embodiments, the plurality of railing modules may comprise at least a first corner railing module, where the first corner railing module comprises at least a second flange extending perpendicular to the railing post, and where a distance between the second flange and the first flange at least partially indicates an angle at the first corner railing module. In some implementations, the first flange may be attached to the railing post. In some aspects, the first flange and the railing post may comprise a single extrusion.

The support surface may comprise a subflooring, where one or both the stud and the sleeve extend through a finish surface. The railing post may be in contact with the finish surface and not in contact with the subflooring. In some aspects, a counter-force mechanism may be detachably connected to a portion of the stud located between the subflooring and the finish surface, where the counter-force mechanism reduces downward force on the finish surface. The stud may be perpendicular to the subflooring and one or both the sleeve and the railing post may be perpendicular to the finish surface. In some aspects, the railing may be oriented parallel to the support surface. In some embodiments, at least one railing module may be oriented at an angle other than perpendicular to the railing post. The railing post may be oriented perpendicular to the support surface.

The retainer cap may comprise an adjustable flange configured to pivot in a predefined angular range relative to one or both the retainer cap connector and the railing. The concealed anchor system may further comprise a base detachably connected to the support surface, where the stud extends vertically from the base. The base may comprise positional indicators. In some aspects, the retainer cap connector may comprise a threaded rod or a tensioned cable. The railing system may comprise a cable railing system, where the railing post may comprise at least one cable flange extending perpendicular from at least one surface of the railing post, where the at least one cable flange is configured to accept a cable connecting at least a portion of the plurality of railing modules.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure:

FIG. 5A illustrates exemplary embodiments of standard retainer caps, according to some embodiments of the present disclosure.

FIG. 5B illustrates exemplary embodiments of standard retainer caps, according to some embodiments of the present disclosure.

FIG. 6A illustrates exemplary embodiments of corner retainer caps, according to some embodiments of the present disclosure.

FIG. 6B illustrates exemplary embodiments of corner retainer caps, according to some embodiments of the present disclosure.

DETAILED DESCRIPTION

The present disclosure provides generally for a railing system. More specifically, the present disclosure relates to a durable and sleek railing system designed to limit deterioration of connection components and connection points, particularly damage that may be caused by exposure to weather elements, such as precipitation, humidity, wind, particulate, or other environmental conditions, as non-limiting examples.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Railing Module: as used herein refers to a railing component within a railing system, wherein a railing system may comprise a series of railing modules. In some aspects, a railing module may comprise a single railing post. The series of railing modules may comprise a mix of standard railing posts and corner railing posts, wherein the series may form a railing border around a surface, such as a deck, porch, or patio.

Guardrail Module: as used herein refers to a guardrail component within a guardrail system, wherein a guardrail system may comprise a series of guardrail modules.

Concealed Anchor System: as used herein refers to an anchor system that may be used in conjunction with a railing module, wherein the concealed anchor system may allow for a discreet anchoring of the railing module to the flooring surface.

Figure 1:
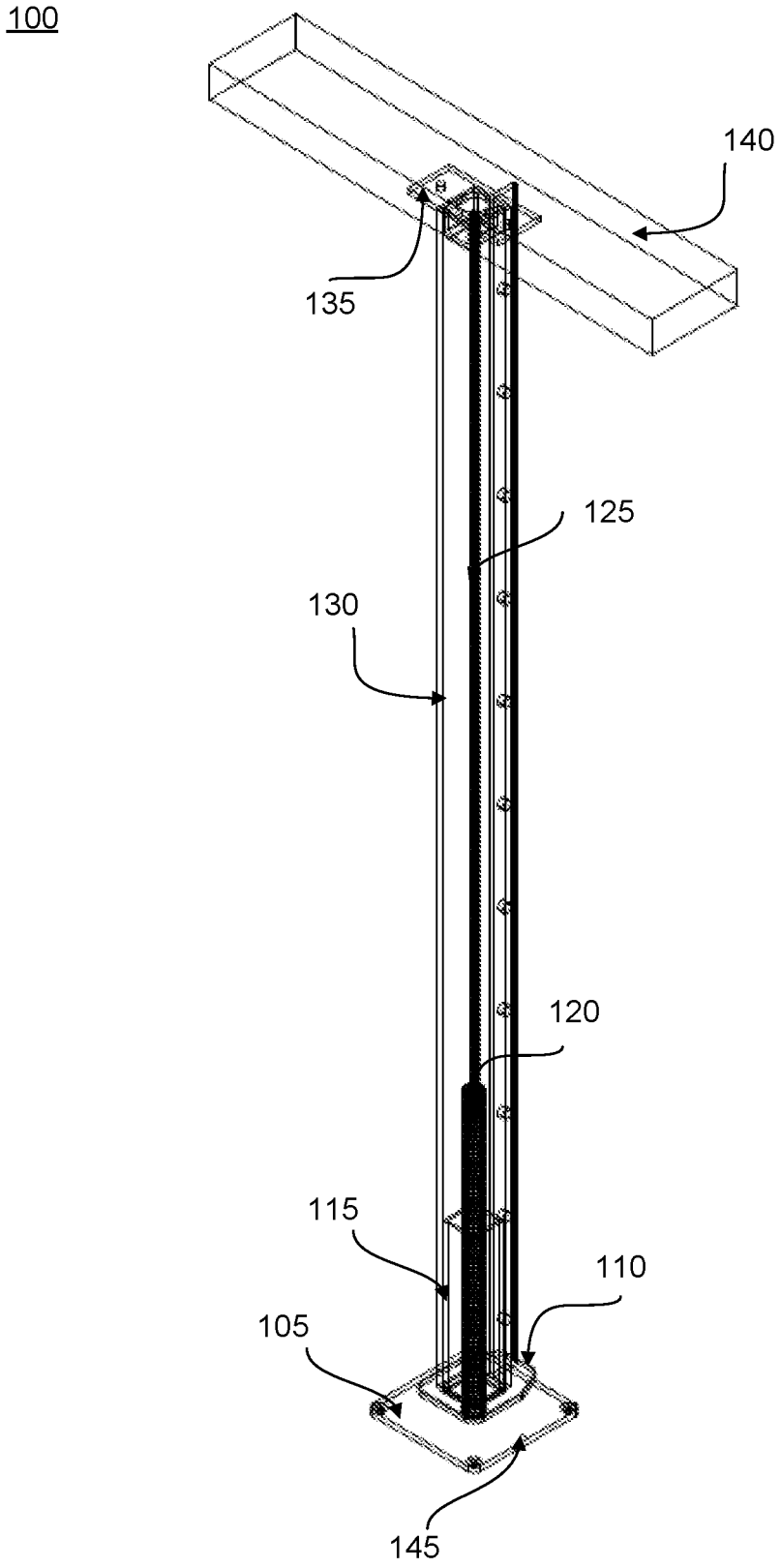
FIG. 1 illustrates an exemplary railing module with concealed anchor system.

Referring now to FIG. 1, an exemplary railing module 100 with concealed anchor system is illustrated. In some aspects, a concealed anchor system may comprise a base 105 and a stud 120, wherein the base 105 may be attached to a flooring surface or subsurface, such as wood decks or concrete decks, as non-limiting examples, and the stud 120 may extend through at least a portion of the deck. In some embodiments, a sleeve 115 may be set around the stud 120, wherein a railing post 130 may be fitted over the stud 120. In some implementations, leveling for the railing system may occur during the installation of the sleeve 115, such as with the use of a three-point leveler, as described in FIG. 9. In some aspects, an adjustable pin (not shown) may tighten with a set screw to facilitate dropping into a threaded base. In some embodiments, a sleeve may have a telescoping feature. In some implementations, a sleeve may use a custom extrusion to facilitate a telescoping feature.

In some embodiments, the installation may depend on the type of flooring system. For example, where the flooring may comprise a concrete flooring, the base 105 may be attached directly to the top surface of the concrete or may be installed during the concrete pouring, wherein the base 105 may be located within the concrete flooring with the stud 120 extending from the concrete. In some embodiments, the stud 120 may be drilled directly into the flooring, such as concrete, wherein the stud 120 may be further stabilized with a setting material, such as an epoxy. In some aspects, the base 105 may comprise positional indicators 145, such as markings or notches, which may assist in the installation process. For example, the positional indicators 145 may indicate the center of each side of the base 105, which may allow for simplified or easier centering along with chalk alignment lines during installation.

In some embodiments, a counter force mechanism may be used to limit damage that may be caused by unsupported unilateral pressure. As an example, the flooring may comprise a floating wood deck, wherein the wood deck may comprise a sloped subflooring that allows for effective water drainage. The base 105 may be attached to the sloped subflooring with the stud 120 extending through the wood deck. The sleeve 115 may be set at the upper surface of the wood deck, and a counter-force mechanism may be installed under the wood deck to limit sagging. In some aspects, the counter-force mechanism may comprise a nut and washer or bracers between the subflooring and the lower surface of the wood deck.

In some aspects, a threaded rod 125 may extend from the stud 120 to a retainer cap 135, which may allow a railing 140 to be secured to the railing module 100. In some embodiments, a flange nut may be threaded onto the threaded rod 125 to the connection point with the stud 120, wherein the flange nut may lock the threaded rod 125 in place, limiting the chance of loosening over time. In some implementations, a shoe 110 may be fitted at the base of the railing post 130, wherein the shoe 110 may limit directional stress. In some aspects, the respective lengths of the threaded rod 125 and the stud 120 may vary depending on the particular application or flooring type.

In some aspects, not shown, a cable may be used instead of a threaded rod 125, wherein the cable may be anchored to the stud 120 and the retainer cap 135, wherein tightening the cable may create tension sufficient to limit shifting. In some embodiments, such as between the retainer cap 135 and the railing 140, a layer of material may be added to create a seal that may further limit internal exposure to moisture. For example, a rubber layer may create a seal when compressed during the tensioning of the cable or the tightening of the threaded rod.

In some embodiments, one or more the railing post 130 and the railing 140 may be modular, wherein one or both the railing post 130 and the railing 140 may be interchangeable with other versions. For example, homeowners may prefer to change the aesthetic of their home periodically, and a modular embodiment may allow the homeowners to switch their current stainless steel railing with cables to a black railing with glass panels. A modular embodiment may allow for replacement of damaged portions of the railing system without requiring a complete dismantling of the railing system, which may cause damage to the flooring and may require a completely new installation.

For example, where the base 105 may be attached to a top surface with nominal slope, the length of the stud 120 may not be a significant factor in the leveling of the railing system and additional length may add stability. Where the base 105 may be attached to a sloped surface, such as on subflooring sloped to help with drainage, the effective length of the stud 120 may be limited to allow for the leveling of the railing system.

In some embodiments, a concealed anchor system may be customized for a variety of deck variations, such as an open deck or decking involving wood, composite, aluminum, or vinyl materials. In some implementations, a concealed anchor system may be optimized depending on decking material, such as wood-thermoplastic composite materials, polyethylene, polypropylene, wood fibers, recycled plastic, PVC, polystyrene, stainless steel, Trex, Ipe, Meranti, Redwood, or pressure-treated lumber, as non-limiting examples. In some aspects, a post may be optimized depending on the decking material. In some embodiments, installation of a concealed anchor system on concrete may occur by drilling a threaded stud into a deck without using a base. In some implementations, a rail may be grouted for use in a pool.

In some embodiments, a concealed anchor system may have a receiver piece that slides over using a threaded rod. In some implementations, a concealed anchor system may have decorative features to complement a user's preferences. In some aspects, a post design may be used to mount to a wall for shelving. For example, a wall mount version may comprise two concealed anchor systems attached perpendicular to a wall, and a shelf may comprise openings that may be fitted onto the sleeves of the concealed anchor systems. In some embodiments, the base may be attached to the exterior of the wall. In some aspects, the base may be attached to studs, such as during construction before the installation of drywall. In some aspects, the concealed anchor system may be integrated into furniture. For example, legs of a table or couch may be fitted over the sleeve of a concealed anchor system, wherein the base may be attached to the seat portion or tabletop.

In some aspects, the concealed anchor system may be used in architectural features where it may be desirable to limit damage to the flooring or necessary to periodically change, repair, or remove the feature fitted over the concealed anchor system. For example, the concealed anchor system may be used to secure base features in an aquarium wherein the anchor system may maintain the sealed integrity of the aquarium and limit corrosion to the features. As another illustrative example, the concealed anchor system may be used to secure sculptural works at a museum, such as exterior statues or installation pieces that may be periodically rotated out.

In some implementations, a concealed anchor system may include different sleeves or different bases to use depending on user need. For example, where the railing post may comprise a cylindrical body, a square-shaped sleeve may not offer the most secure fit. In some embodiments, the sleeve may comprise a textured exterior, which may cause friction with the railing post and limit rotation of the railing post around the sleeve. In some aspects, the railing post may comprise an internal structure that may be fittingly secured over the sleeve that may not match the exterior. For example, the railing post may by cylindrical on the outside and have a square-shape internally that may fit over a square-shaped sleeve, wherein the square fitting may limit rotation of the railing post.

Figure 2:
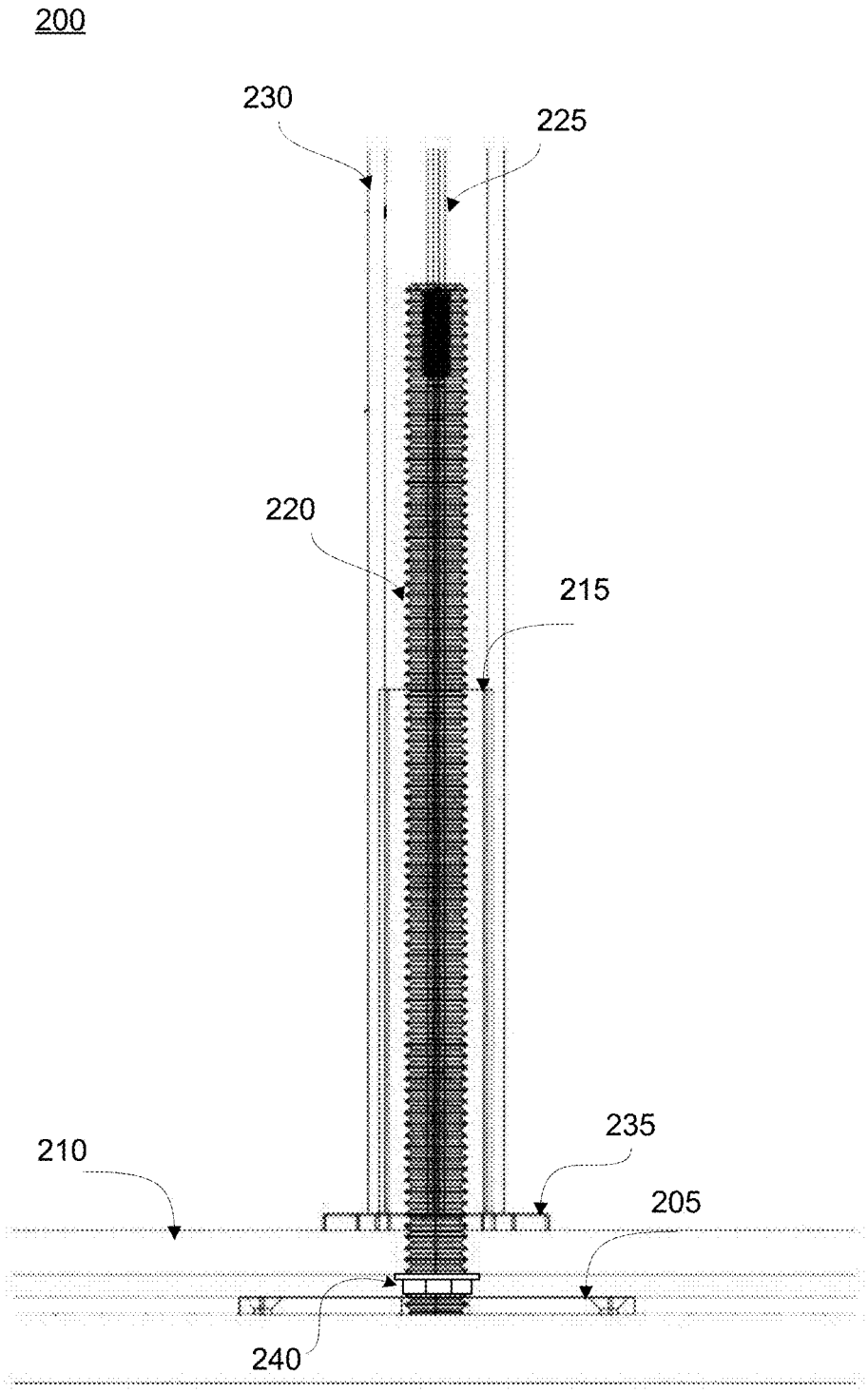
FIG. 2 illustrates an exemplary railing module with concealed anchor system in a cross-sectional view.

Referring now to FIG. 2, a portion of an exemplary railing module 200 with concealed anchor system is illustrated in a cross-sectional view. In some aspects, the concealed anchor system may comprise a base 205, which may be anchored below a finished flooring system 210, such as on a wood deck or a tile deck. In some implementations, there may be subflooring that may be reinforced to limit sagging that may be caused by a stud 220 extending between the subflooring and flooring. In some implementations, the sleeve 215 may comprise a counter-force mechanism 240, which may be installed under the wood deck to limit sagging. In some aspects, the counter-force mechanism 240 may comprise a nut and washer or bracers between the subflooring and the lower surface of the wood deck. In some embodiments, a sleeve 215 may be fitted around the stud 220. In some implementations, a threaded rod 225 may be attached to the stud 220. In some aspects, the threaded rod 225 may allow for a railing to be attached to the railing system without requiring piercing a railing post 230 or finished flooring system 210. In some implementations, a base shoe 235 may be placed over the railing post 230 in contact with the finished flooring system 210.

Figure 3A:
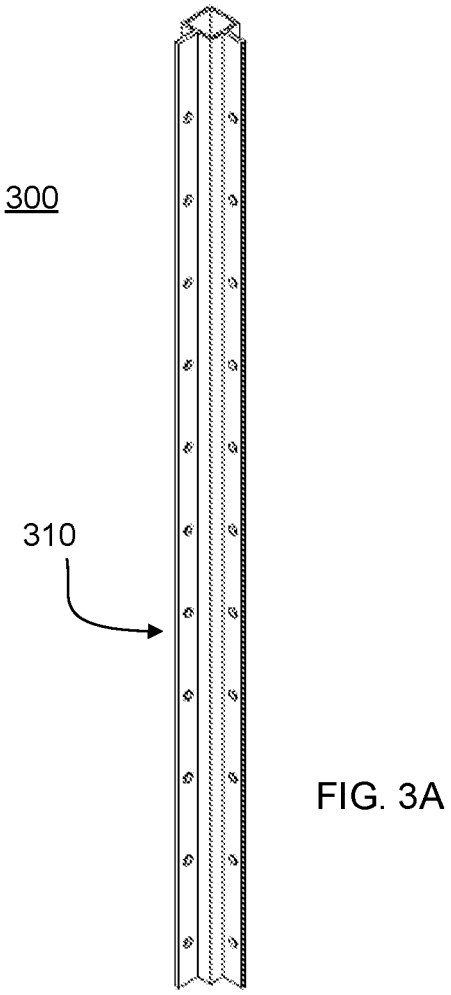
FIG. 3A illustrates an exemplary embodiment of railing posts with cable flanges, according to some embodiments of the present disclosure.
Figure 3B:
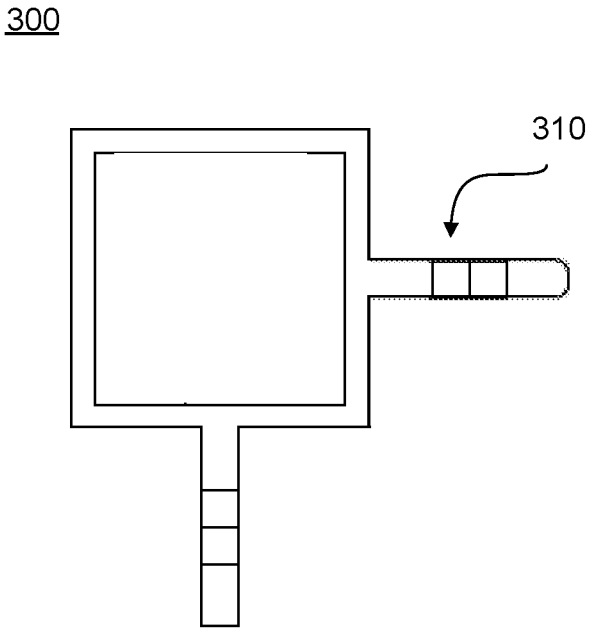
FIG. 3B illustrates an exemplary embodiment of railing posts with cable flanges, according to some embodiments of the present disclosure.

Referring now to FIGS. 3A-3B, an exemplary embodiment of railing posts 300 with cable flanges 310 are illustrated. In some embodiments, a railing system may comprise a cable railing system, wherein the upper railing may comprise a rigid material and the secondary railings may comprise cables. In some aspects, a railing post 300 may comprise one or more cable flanges 310, which may comprise a series of holes configured to accept the cables.

In some implementations, the series of holes may comprise the same or different shapes. For example, a larger hole may accept an end cap for the cable railing, whereas a smaller hole may allow for a cable pass-through. In some aspects, a corner railing may comprise two cable flanges 310 extending from perpendicular surfaces of the railing post, which may allow for a 90° turn in the railing system. In some embodiments, the angle between the cable flanges 310 may allow for a range of perimeter shapes.

In some aspects, the use of flanges eliminates the need for the cables to pass through the body of the railing post, which may expose portions of the railing post. The exposed portions may be susceptible to damage over time, which may weaken the components. For example, a drilled hole on the surface of the railing post may allow moisture to accumulate within the railing post, which may cause deterioration to the drilled hole, the interior of the railing post, the retainer cap, or other exposed components within the railing module.

In some embodiments, not shown, railing posts may comprise flanges that may accept other horizontal railing systems, such as rods, panels, or boards, as non-limiting examples. For example, the flanges may comprise a pocket configured to accept a panel that may extend to the next railing post. The panel may comprise one or more of a wood, plastic, glass, steel, or aluminum, as non-limiting examples. In some aspects, not shown, the railing system may comprise a series of vertical railings and the railing post may comprise flanges that may accept a base railing, wherein the panels, balusters, or rods may extend between the base railing and the upper railing. In some implementations, not shown, the railing post may comprise traditional railing designs utilizing the concealed anchor system as the means of attachment to a structure.

Figure 4A:
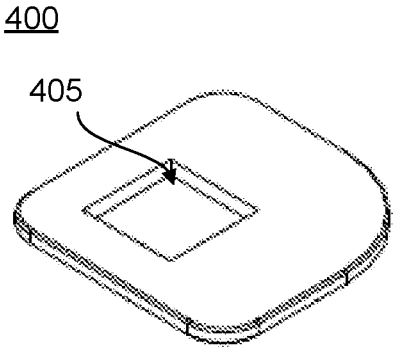
FIG. 4A illustrates an exemplary embodiment of a standard post base shoe, according to some embodiments of the present disclosure.
Figure 4B:
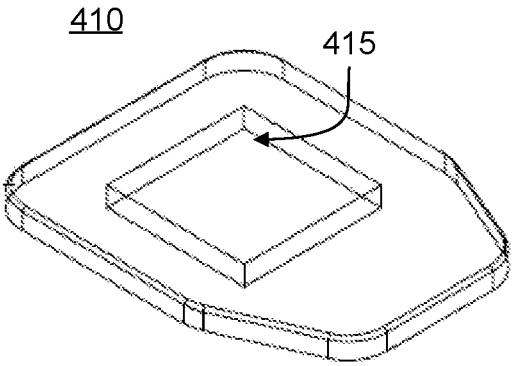
FIG. 4B illustrates an exemplary embodiment of a corner post base shoe, according to some embodiments of the present disclosure.

Referring now to FIGS. 4A-4B, exemplary embodiments of post base shoes 400, 410 are illustrated. In some embodiments, a corner post base shoe 400 may be configured to reduce concurring perpendicular stress. In some aspects, a standard base post shoe 410 may be configured to limit directional stress. For example, a railing post may be leaned on or pulled directly or indirectly, such as by pulling or pushing on the railing attached to the railing posts.

In some embodiments, the post base shoes 400, 410 may comprise an opening 405, 415 that may fit over the sleeve and under the railing post. In some aspects, the base shoes 400, 410 may be fitted with concealed securing mechanisms, maintaining a sleek exposed upper surface. For example, the post base shoes 400, 410 may be attached to the flooring surface with an adhesive. As another example, where a metal base may be exposed, the post base shoes 400, 410 may be magnetically connected to the base. In some aspects, the post base shoes 400, 410 may be allowed to float without being attached to a surface. In some implementations, a base shoe 400, 410 may distribute the point load of a railing once a nut is tightened on the retainer, which may limit compression of the railing post into the finished deck while adding rigidity to the rail post installation.

Referring now to FIGS. 5A-5B, exemplary embodiments of standard retainer caps 500 are illustrated. In some aspects, a standard retainer cap 500 may be secured to a concealed anchor system through a threaded rod extending from a stud. In some aspects, the standard retainer cap 500 may comprise a fitted portion 515 with a center hole 510 and a retainer base 530. In some embodiments, the fitted portion 515 may fit within the body of the railing post, wherein the center hole 510 may align with the threaded rod. The threaded rod may extend up to or through the center hole 510, which may allow for a nut to secure the standard retainer cap 500 to the railing module. In some aspects, railing may be secured to the retainer base 530, wherein the retainer base 530 may be parallel to the railing.

Referring now to FIGS. 6A-6B, exemplary embodiments of corner retainer caps 600 are illustrated. In some embodiments, a corner retainer cap 600 may be secured to a concealed anchor system through a threaded rod extending from a stud. A corner retainer cap 600 may be configured to secure a corner railing piece. In some aspects, a corner railing piece may comprise an angled portion.

In some aspects, the corner retainer cap 600 may comprise a fitted portion 610 with a center hole 615 and a retainer base 630. In some embodiments, the fitted portion 610 may fit within the body of the railing post, wherein the center hole 615 may align with the threaded rod. The threaded rod may extend up to or through the center hole 615, which may allow for a nut to secure the corner retainer cap 600 to the railing module. In some aspects, railing may be secured to the retainer base 630, wherein the retainer base 630 may be parallel to the railing.

Figure 7A:
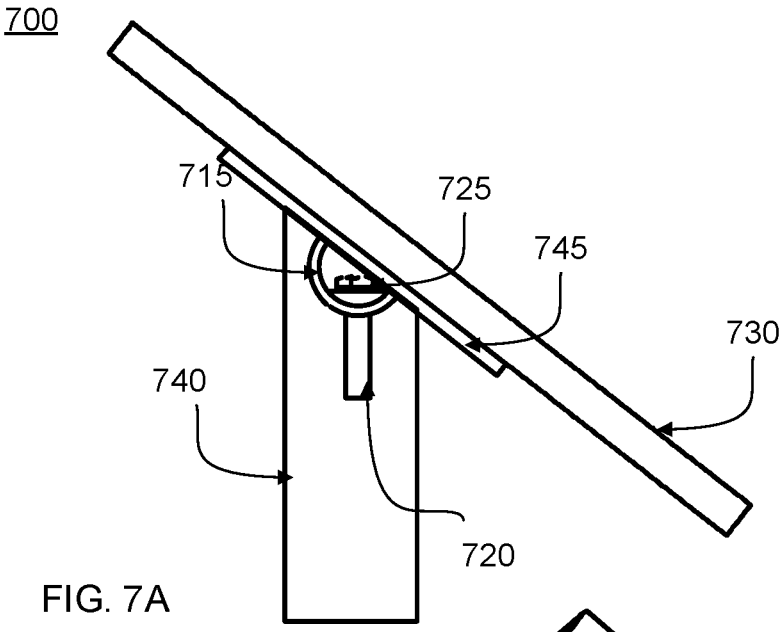
FIG. 7A illustrates an exemplary embodiment of an adjustable flange, according to some embodiments of the present disclosure.
Figure 7B:
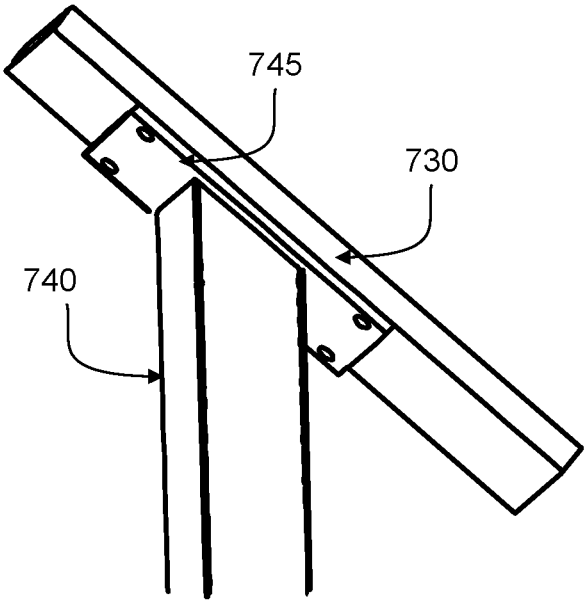
FIG. 7B illustrates an exemplary embodiment of a railing system with adjustable flange.
Figure 7C:
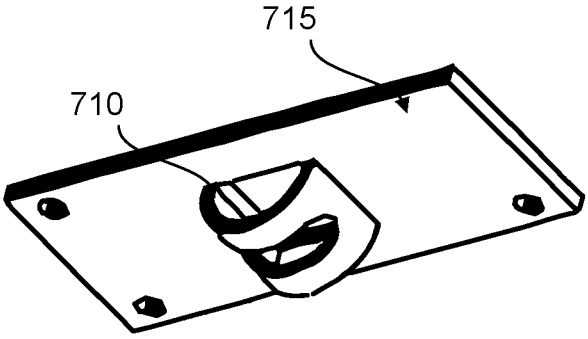
FIG. 7C illustrates an exemplary embodiment of a railing system with adjustable flange.

Referring now to FIGS. 7A-7C, exemplary embodiments of a railing system 700 with adjustable flange 715 is illustrated. In some aspects, an angled railing system 700 may be installed for sloped surfaces, such as stairs or ramps. In some embodiments, a retainer cap 745 may comprise an adjustable flange 715 that may pivot around a threaded rod 720, wherein the position and angle may be adjusted using a nut 725 configured in the barrel portion 710 of the adjustable flange 715 to limit horizontal movement. In some aspects, a railing post 740 may be precut to the angle of the sloped surface, wherein the angle of installation of a railing 730 may be predefined. In some embodiments, an adjustable flange 715 and retainer cap 745 with adjustable flange 715 may pivot with the angle of the stairs or ramp for which the railings are to be installed. In some implementations, the railing post 740 may be cut to a desired angle and the angled railing system 700 may utilize the anchoring system described above.

Figure 8A:
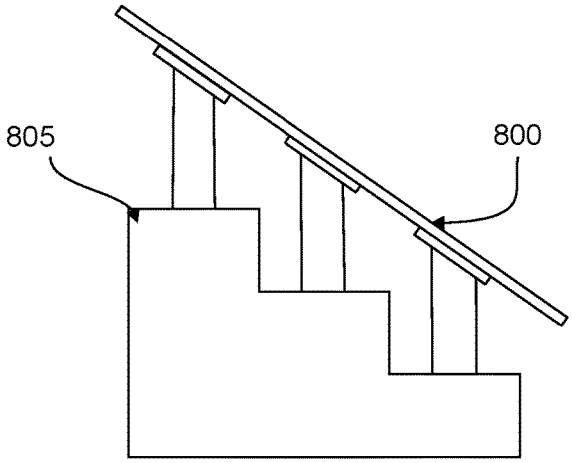
FIG. 8A illustrates an exemplary embodiment of a sloped surface with angled railing system.
Figure 8B:
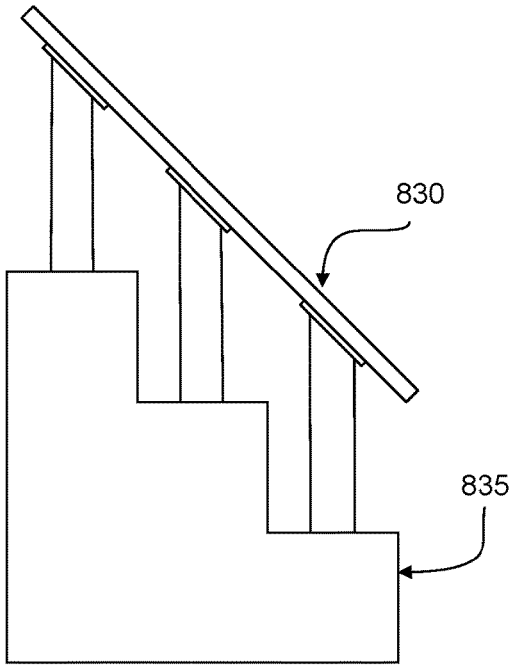
FIG. 8B illustrates an alternate exemplary embodiment of a sloped surface with angled railing system.
Figure 8C:
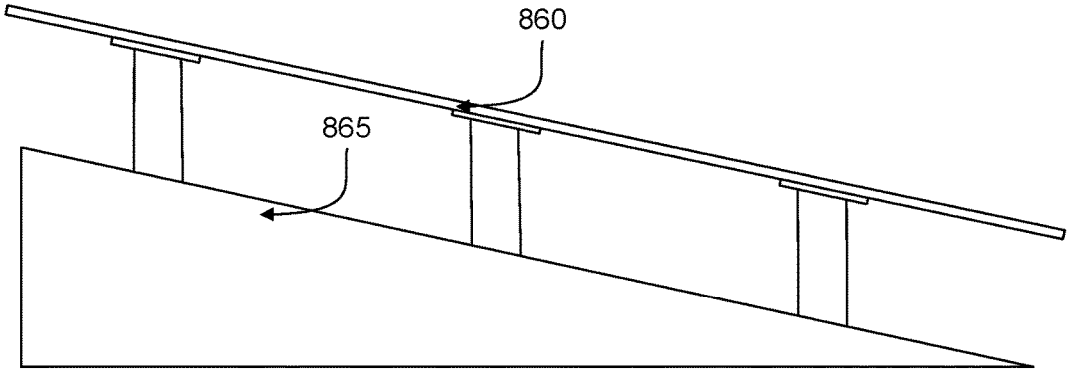
FIG. 8C illustrates an alternate exemplary embodiment of a sloped surface with angled railing system.

Referring now to FIGS. 8A-8C, exemplary embodiments of sloped surfaces 805, 835, 865 with angled railing systems 800, 830, 860 are illustrated. In some aspects, an adjustable flange, such as illustrated in FIGS. 7A-7C, may allow for the custom installation of angled railing systems 800, 830, 860. Stairs or ramps may be installed at a range of angles for a variety of reasons, including aesthetic preferences, spatial limitations, or accessibility requirements, as non-limiting examples.

In some aspects, standard stairs 805 with standard angled railing system 800 may have a traditional aesthetic with sufficient space to extend the steps. In some embodiments, steep stairs 835 with steep angled railing system 830 may have a more modern aesthetic and may be appropriate where space is limited. In some implementations, a ramp 865 with moderate angled railing system 860 may allow for increased accessibility.

Figure 9:
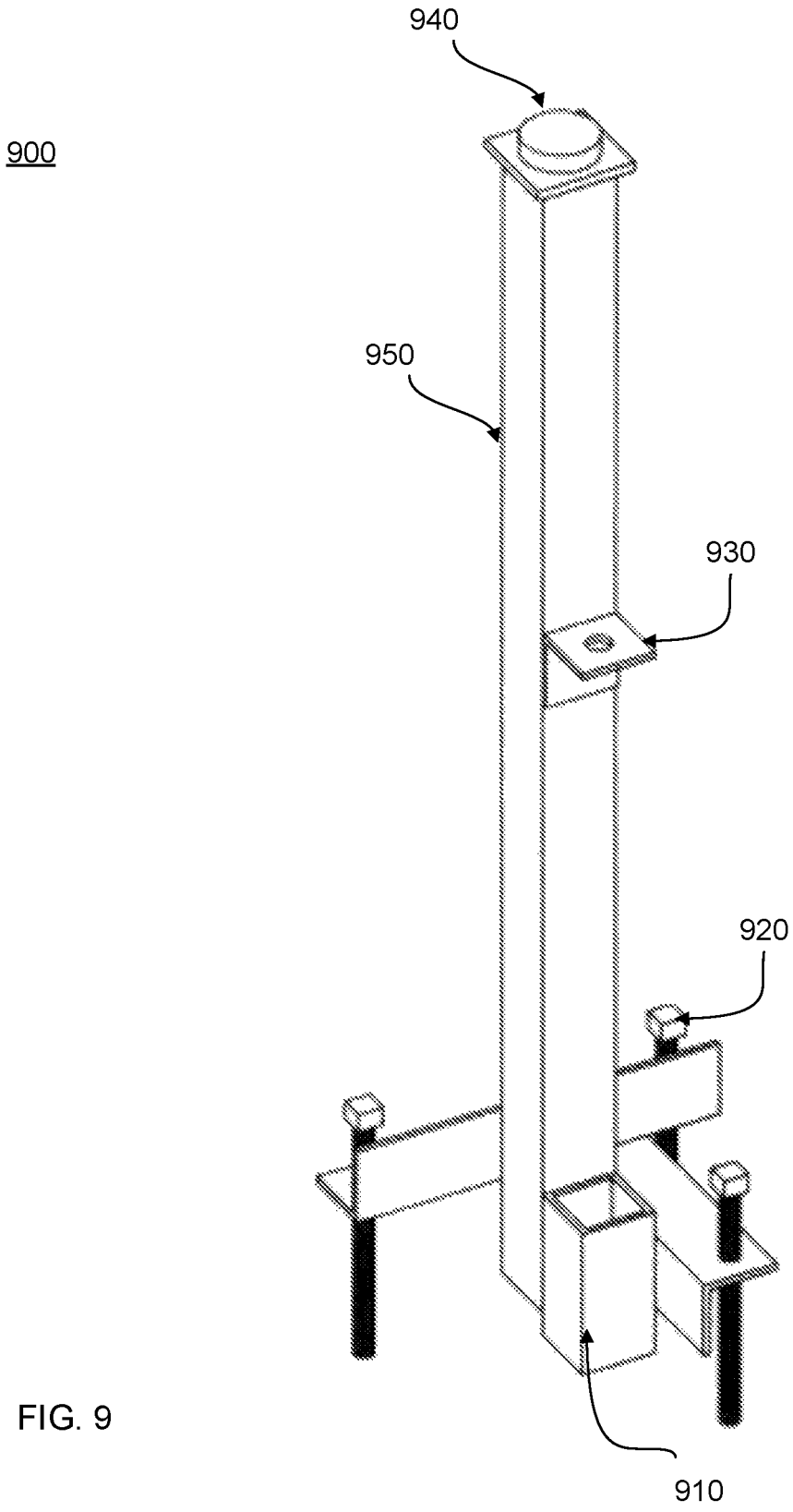
FIG. 9 illustrates an exemplary embodiment of a leveler, wherein the leveler may be used to install a railing system with concealed anchor system.

Referring now to FIG. 9, an exemplary embodiment of a leveler 900 is illustrated, wherein the leveler 900 may be used to install a railing system with concealed anchor system, such as illustrated in FIGS. 1 and 2. In some implementations, a leveler 900 may be used to install the sleeve of a concealed anchor system. A leveler 900 may be useful in a range of applications, in particular where one or both the base or the stud may be installed on a sloped surface. The leveler 900 may allow for a level installation of railing posts that are perpendicular to the ground, regardless of the slope of the flooring surface.

In some aspects, the leveler 900 may comprise adjustable legs 920 that may support the leveler 900, wherein each of the adjustable legs 920 may be independently adjusted. In some implementations, the adjustable legs 920 may comprise feet (not shown) that may add stability and limit damage to the flooring. For example, the feet may comprise a rubber or foam that may create a soft contact point with the flooring. As another example the feet may comprise a round base that may disperse any pressure to limit indentations that may be caused during the leveling process. In some embodiments, the leveler 900 may comprise a primary alignment mechanism 910, which may hold the sleeve of a railing module. The primary alignment mechanism 910 may comprise a sleeve, clamps, magnets, or other securing mechanisms, as non-limiting examples. In some embodiments, the primary alignment mechanism 910 may comprise a quick-release mechanism, such as a spring-loaded release mechanism, which may allow for easy alignment and installation.

In some aspects, the leveler 900 may comprise a secondary alignment mechanism 930, which may further secure the leveler 900 in alignment while the sleeve of a railing module is set to the stud. For example, the secondary alignment mechanism 930 may comprise a recess or flange with a hole that may accept a threaded rod connected to the stud or the stud itself. In some embodiments, the leveler 900 may comprise a bubble level 940 at the top of a stem 950. In some aspects, the length of the stem 950 may allow for a user to lean over to look down over the bubble level 940.

Figure 10:
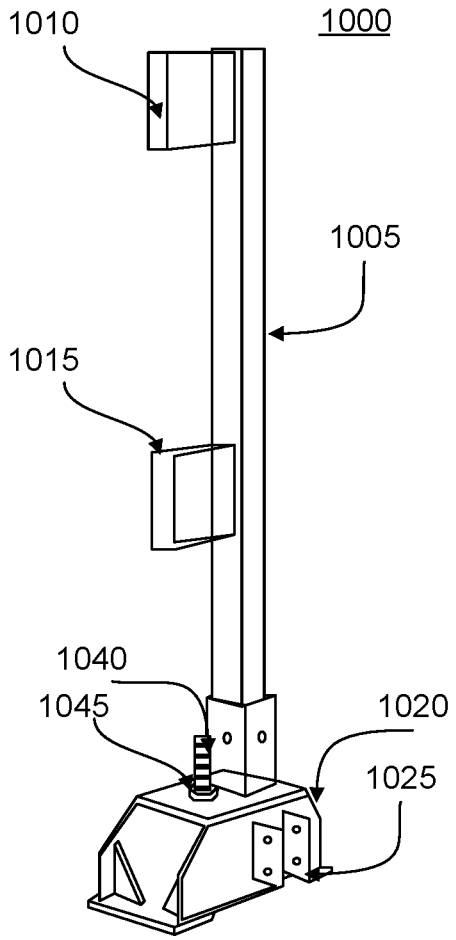
FIG. 10 illustrates an exemplary guardrail module, according to some embodiments of the present disclosure.

Referring now to FIG. 10, an exemplary guardrail module 1000 is illustrated. During construction, a common safety requirement is a temporary guardrail along the perimeter of walking work surfaces, which may reduce the chance of an individual falling off the edge of a walkway. More specifically, the guardrail must typically have an upper rail, intermediate rail, and posts. Common guardrail solutions include installing temporary posts that extend from floor to ceiling that may be clamped to a slab or mechanically fastened to a structure. In some versions, the temporary posts risk damaging one or both the floor or ceiling and impede efficient installation of deck finishes.

Accordingly, FIGS. 10-12C describe an improved guardrail system that may utilize permanent fixtures within its construction. In some aspects, the guardrail module 1000 may be fitted to a foundation using a concealed anchor system, which may comprise a base (not shown) and stud 1040. In some aspects, the guardrail module 1000 may comprise an upper support brace 1010 and a lower support brace 1015 extending from a post 1005. The post 1005 may extend from a boot 1020, wherein the boot 1020 may comprise a base support brace 1025 and an aperture to fit over the stud 1040 of the concealed anchor system. In some aspects, a bolt or washer 1045 may be used to secure the boot 1020 to the stud 1040 through the aperture.

Figure 11:
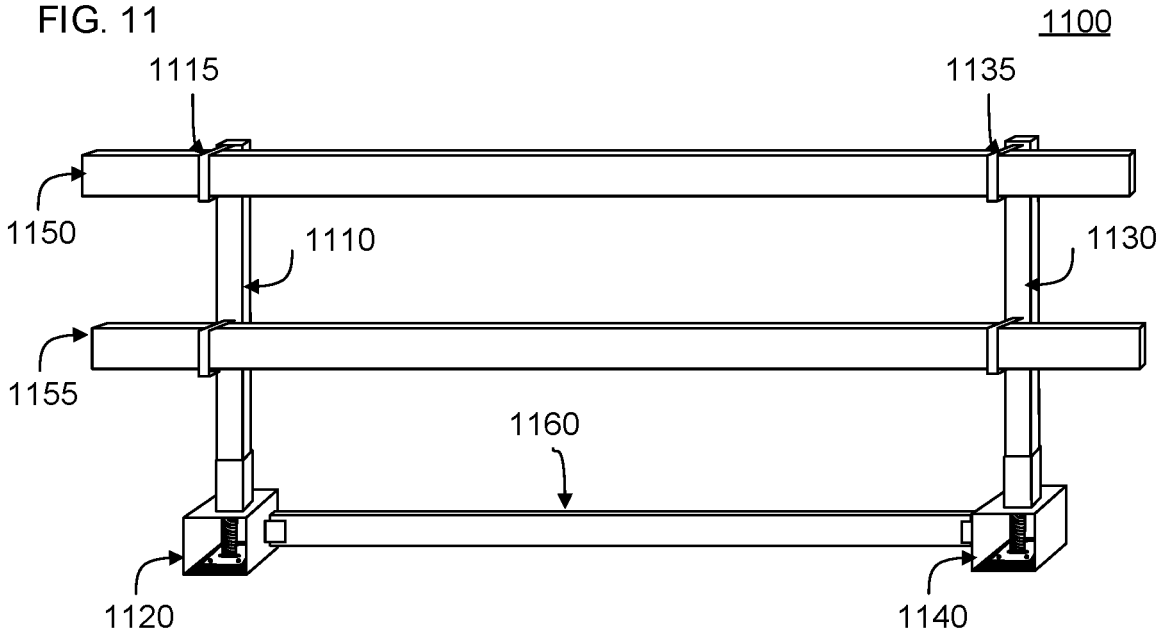
FIG. 11 illustrates an exemplary guardrail system, according to some embodiments of the present disclosure.

Referring now to FIG. 11, an exemplary guardrail system 1100 is illustrated. In some aspects, a guardrail system 1100 may comprise a plurality of guardrail modules 1110, 1130. In some implementations, the guardrail modules 1110, 1130 may support an upper board 1150, a center board 1155, and a base board 1160. In some aspects, one or both the upper board 1150 and the center board 1155 may extend through support braces 1115, 1135 on the guardrail modules 1110, 1130. The base board 1160 may be secured to the boot 1120, 1140 of each guardrail module 1110, 1130, which may increase the stability of the guardrail system 1100.

Figure 12A:
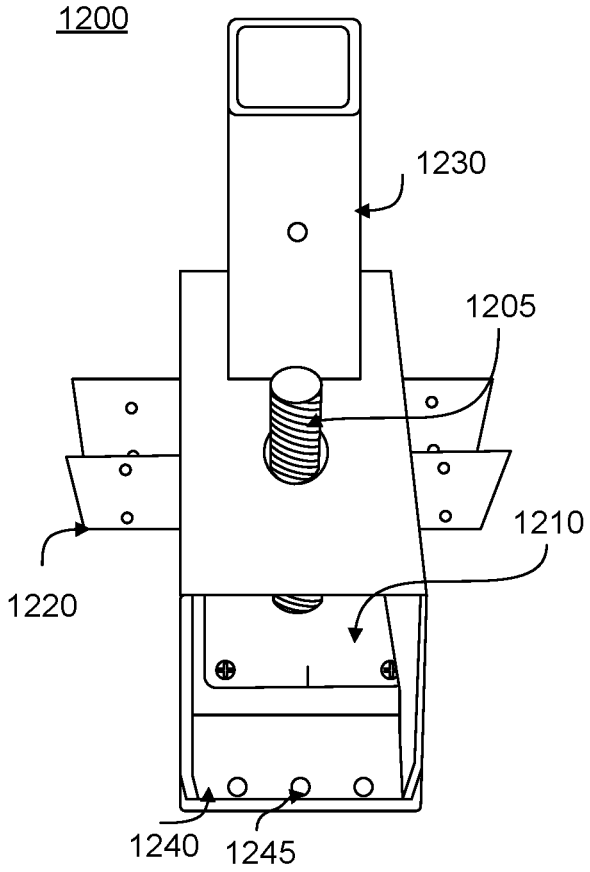
FIG. 12A illustrates an exemplary embodiment of a guardrail module boot, according to some embodiments of the present disclosure.
Figure 12B:
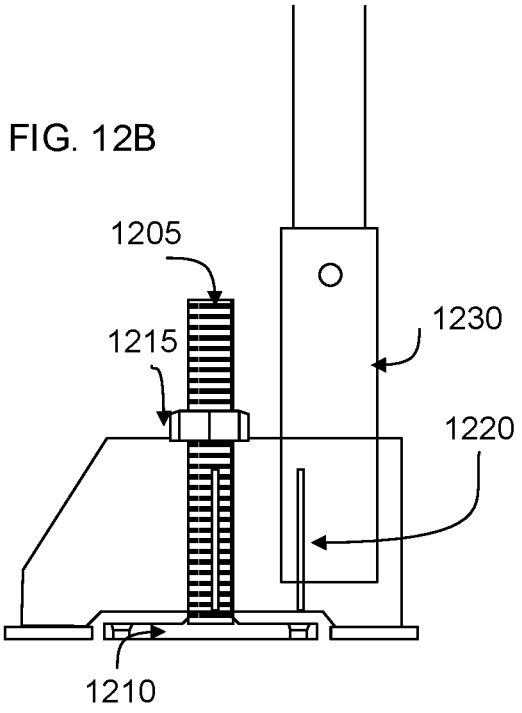
FIG. 12B illustrates an exemplary embodiment of a guardrail module boot, according to some embodiments of the present disclosure.
Figure 12C:
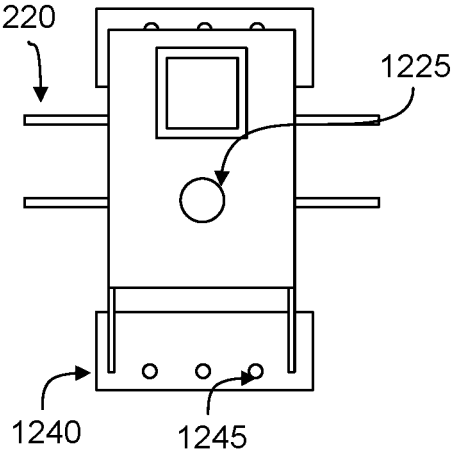
FIG. 12C illustrates an exemplary embodiment of a guardrail module boot, according to some embodiments of the present disclosure.

Referring now to FIGS. 12A-12C, an exemplary embodiment of a guardrail module boot 1200 is illustrated, wherein the guardrail module boot 1200 may be secured in part by a concealed anchor system, which may comprise a stud 1205 and base 1210. In some aspects, a concealed anchor system may be installed for future use in a railing system in a building, such as integrated into a railing system as described in FIGS. 1-8C. During construction, the concealed anchor system may be used in conjunction with a guardrail system.

In some aspects, the guardrail module boot 1200 may comprise a guardrail post sleeve 1230 configured to accept a guardrail post. In some implementations, the guardrail module boot 1200 may comprise a lower support brace 1220 configured to accept an end of a base board, wherein a subsequent guardrail module boot may comprise another lower support brace to accept the other end of the base board. In some embodiments, the guardrail module boot 1200 may comprise an aperture 1225 and stability panels 1240 with drill holes 1215. The aperture 1225 may be configured to receive a stud 1205 from a concealed anchor system.

In some aspects, the stability panels 1240 may be drilled into a surface through the drill holes 1245, such as where flooring finishes have not been installed or partially installed or where damage to the surface may be easily repaired. In some embodiments, it may not be necessary or desirable to drill into the floor. For example, where the flooring may be partially installed, damage to the surface may not be easily repaired, so drilling into the flooring may cause unwanted damage. In some aspects, the stability panels 1240 may comprise non-skid material underneath to limit unintended slipping, wherein the non-skid material may comprise a material that may not damage the flooring, such as a rubber or silicone.

In some implementations, the guardrail post sleeve 1230 and guardrail module boot 1200 may be designed to allow for easy removal and re-installation of the upper portion of a guardrail post without the need to remove or unsecure the base. In some aspects, a retainer pin may be placed in the hole of the receiver with an aligned hole in the guardrail post. In some embodiments, this feature may provide better flexibility to a contractor and provide less wear on a deck.

Figure 13:
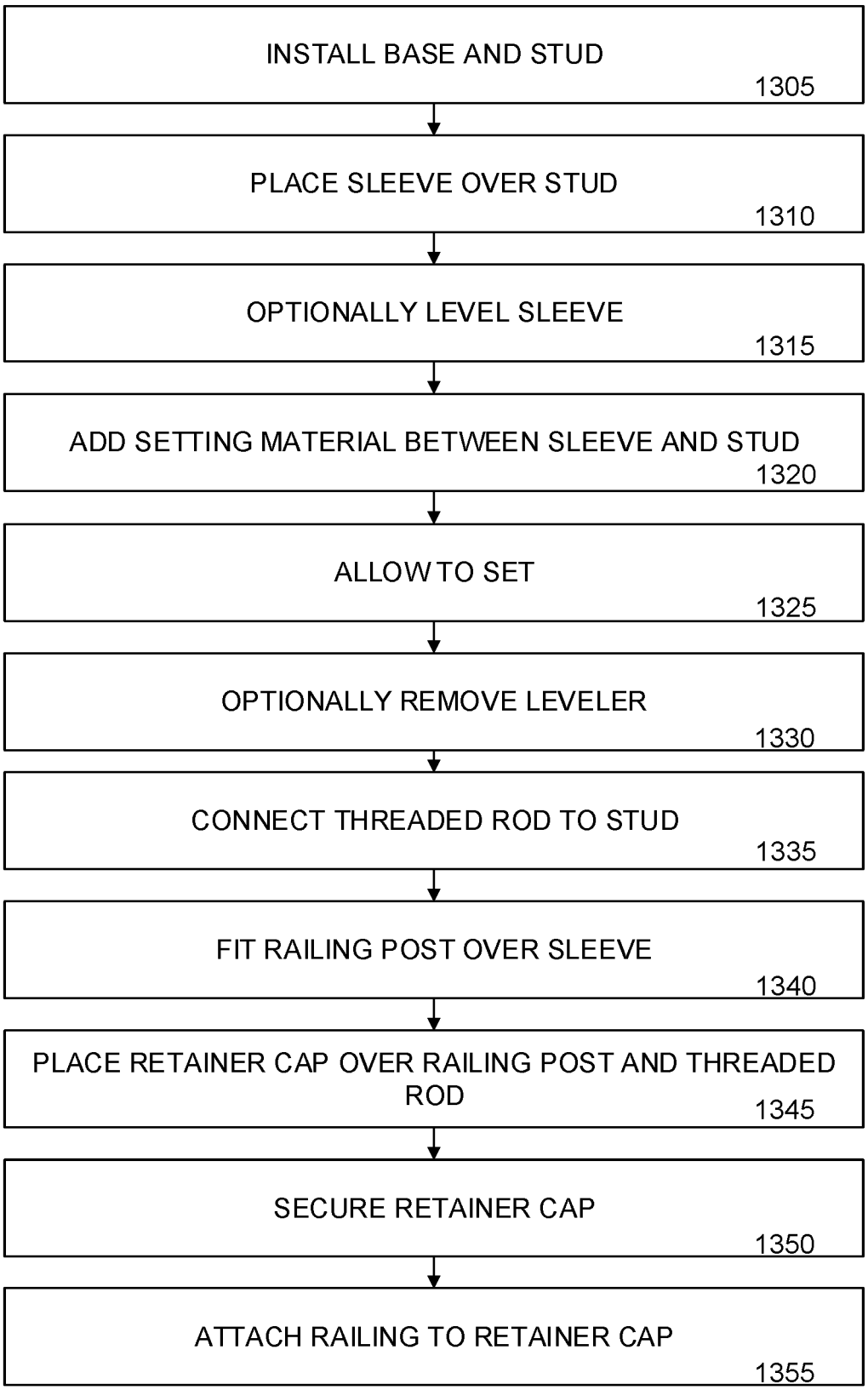
FIG. 13 illustrates exemplary method steps for installing a railing module with concealed anchor system.

Referring now to FIG. 13, exemplary method steps for installing a railing module with concealed anchor system are illustrated. At 1305, the base and stud may be installed. At 1310, a sleeve may be placed over the stud. In some aspects, at 1315, the sleeve may be leveled. At 1320, setting material may be added between the sleeve and the stud, and at 1325, the setting material may be allowed to set. For example, the setting material may comprise an epoxy, a concrete, a glue, or other setting materials. In some aspects, at 1330, the leveler may be removed.

At 1335, a threaded rod may be connected to the stud. At 1340, a railing post may be fitted over the sleeve. At 1345, a retainer cap may be placed in the railing post and threaded rod, and at 1350, the retainer cap may be secured, such as through use of a bolt or washer threaded over the threaded rod. At 1355, a railing may be attached to the retainer cap.

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A railing system comprising:

a plurality of railing modules, wherein each railing module comprises:

a concealed anchor system comprising:

a stud extending vertically from a support surface;

a sleeve centered around the stud extending perpendicular to the support surface;

a railing post configured to fit around the sleeve, wherein the railing post comprises a bottom opening configured to accept the sleeve and a top opening and an interior extending from the bottom opening to the top opening;

a retainer cap connector detachably connected and extending vertically from the stud;

a retainer cap configured to fit into the top opening, wherein the retainer cap is detachably connected to the retainer cap connector; and a railing detachably connected to the retainer cap, wherein the railing connects at least a portion of the plurality of railing modules, wherein piercing the interior of the railing post is not required for connection of the retainer cap connector, the retainer cap, or the railing to the railing post.

2. The railing system of claim 1, wherein each railing module further comprises a securing mechanism detachably connected to one or both the stud and the retainer cap connector, wherein the securing mechanism strengthens the connection between the stud and the retainer cap connector.

3. The railing system of claim 1, wherein each railing module further comprises a shoe configured to fit over the railing post, wherein the shoe is in contact with the support surface.

4. The railing system of claim 3, wherein the railing post further comprises at least a first flange extending perpendicular to the railing post, wherein the first flange comprises one or more recesses or openings configured to fit at least one secondary railing detachably connected to at least the portion of the plurality of railing modules.

5. The railing system of claim 4, wherein the plurality of railing modules comprises at least a first corner railing module, wherein the first corner railing module comprises at least a second flange extending perpendicular to the railing post, and wherein a distance between the second flange and the first flange at least partially indicates an angle at the first corner railing module.

6. The railing system of claim 4, wherein the first flange is attached to the railing post.

7. The railing system of claim 4, wherein the first flange and the railing post comprise a single extrusion.

8. The railing system of claim 1, wherein the support surface comprises a subflooring, and wherein one or both the stud and the sleeve extend through a finish surface.

9. The railing system of claim 8, wherein the railing post is in contact with the finish surface and not in contact with the subflooring.

10. The railing system of claim 8, further comprising a counter-force mechanism detachably connected to a portion of the stud located between the subflooring and the finish surface, wherein the counter-force mechanism reduces downward force on the finish surface.

11. The railing system of claim 8, wherein the stud is perpendicular to the subflooring and one or both the sleeve and the railing post are perpendicular to the finish surface.

12. The railing system of claim 1, wherein the railing is oriented parallel to the support surface.

13. The railing system of claim 1, wherein the railing of at least one railing module is oriented at an angle other than perpendicular to the railing post.

14. The railing system of claim 13, wherein the retainer cap comprises an adjustable flange configured to pivot in a predefined angular range relative to one or both the retainer cap connector and the railing.

15. The railing system of claim 13, wherein the railing post is oriented perpendicular to the support surface.

16. The railing system of claim 1, wherein the concealed anchor system further comprises a base detachably connected to the support surface, wherein the stud extends vertically from the base.

17. The railing system of claim 16, wherein the base comprises positional indicators.

18. The railing system of claim 1, wherein the retainer cap connector comprises a threaded rod.

19. The railing system of claim 1, wherein the retainer cap connector comprises a tensioned cable.

20. The railing system of claim 1, wherein the railing system comprises a cable railing system, wherein the railing post comprises at least one cable flange extending perpendicular from at least one surface of the railing post, wherein the at least one cable flange is configured to accept a cable connecting at least a portion of the plurality of railing modules.

* * * * *